United States Patent [19]

Palmer

[11] Patent Number: 4,783,938

[45] Date of Patent: Nov. 15, 1988

[54] WINDOW PANEL ASSEMBLY

[75] Inventor: Douglas J. Palmer, Mosinee, Wis.

[73] Assignee: SNE Enterprises, Wausau, Wis.

[21] Appl. No.: 152,653

[22] Filed: Feb. 5, 1988

[51] Int. Cl.[4] ..... E06B 3/70

[52] U.S. Cl. ..... 52/171; 52/456; 52/790

[58] Field of Search ..... 52/456, 171, 790

[56] References Cited

U.S. PATENT DOCUMENTS

| | | | |
|---|---|---|---|
| 1,092,727 | 4/1914 | Linder | 52/476 |
| 3,308,593 | 3/1967 | Smith | 52/456 |
| 4,598,520 | 7/1986 | Eilstrom | 52/456 |

FOREIGN PATENT DOCUMENTS

| | | | |
|---|---|---|---|
| 2185516 | 7/1987 | United Kingdom | 52/776 |

*Primary Examiner*—John E. Murtagh

*Attorney, Agent, or Firm*—Michael, Best & Friedrich

[57] ABSTRACT

The insulated window assembly includes a pair of parallel-spaced glass panes, a plurality of intersecting metallic, internal muntin bars disposed in the space between the glass panes, a plurality of intersecting, wooden, exterior muntin bars affixed on the outer surface of the exterior glass pane and a plurality of wooden intersecting interior muntin bars affixed on the outer surface of the interior glass pane. The internal muntin bars have a thickness less than the space between the glass panes. The exterior and interior muntin bars are slightly wider than the internal muntin bars and are coincidentally aligned with each other and with the internal muntin bars to give the window panel assembly the appearance of a historically correct, authentic divided lite window having individual panes separated by conventional muntin bars.

13 Claims, 2 Drawing Sheets

WINDOW PANEL ASSEMBLY

BACKGROUND OF THE INVENTION

This invention relates to windows which appear to have a plurality of individual lites and, in one aspect, multiple-pane, insulated window panel assemblies having such an appearance.

French-style window panels include a plurality of individual lites, an outer frame or casement and smaller frame or sash bars holding individual lites which typically are either rectangular or diamond shaped. Plain window panels have a single glass pane held by an outer frame or casement. French-style window glass panels are preferred for room windows and/or doors in some traditional architectural designs. French-style window panels are substantially more expensive to manufacture than plain windows. Dual-pane, insulated window panel assemblies include two single glass panes separated by and bonded to a peripheral spacer frame to define an insulating air pocket therebetween. In some constructions, this pocket is filled with an inert gas, such as argon or krypton or a mixture of one of these gases and $Sf_6$, to improve the insulating and/or sound deadening characteristics.

Multiple-pane, insulated windows have been constructed with a plurality of individual panels in an attempt to give the appearance of an authentic divided lite window. In order to accommodate the substantially bulkier insulated window panels, the sash bars for the individual panels usually are about twice as wide as conventional sash bars for authentic divided lite or French-style window. Consequently, the resulting overall panel assembly does not have an authentic appearance. Also, the window units are quite heavy and, for gas-filled units, the risk of developing a gas leak failure is increased because of the number of individual lites. Also, with conventional divided lite windows, the muntin bars extend from the outside to the inside and, therefore, create a path for heat loss.

Different approaches have been used to provide multiple-pane, insulated window panels with the appearance of authentic divided lite or French-style windows. U.S. Pat. No. 3,308,593 discloses the use of intersecting, internal muntin bars disposed in the space between the glass panes. While such an arrangement permits unobstructed washing of the outer panes, the window panel does not look much like an authentic divided lite window. Also, the internal muntin bars are made from a metal and can cause frosting and/or condensation if they come in contact with the glass panes.

U.S. Pat. No. 4,598,520 discloses the use of external muntin bars affixed on the outer side of the glass panes without any internal muntin bars. One standing relatively close to the window of such a construction can observe there is nothing in the space between the glass panes which detracts from its simulated appearance as an authentic divided lite or French-style window.

SUMMARY OF THE INVENTION

An object of the invention is to provide a window panel assembly which has the appearance of a historically correct, authentic divided lite or French-style window, may have improved load deflection characteristics and is less expensive to manufacture.

Another object of the invention is to provide a multiple-pane, insulated window panel assembly having the appearance of a historically correct, authentic divided lite or French-style window.

A further object of the invention is to provide such an insulated window panel assembly having improved resistance to condensation.

A still further object of the invention is to provide an insulated window panel assembly having improved thermal efficiency.

Other objects, aspects and advantages of the invention will become apparent to those skilled in the art upon reviewing the following detailed description, the drawings and the appended claims.

The invention provides an insulated window panel assembly including a pair of generally parallel-spaced panes of a transparent sheet material, such as glass, a plurality of intersecting, internal muntin bars disposed in the space between the glass panes, a plurality of intersecting, exterior muntin bars having a width slightly wider than the internal muntin bars affixed by adhesive means on the outer surface of the exterior glass pane in coincidental alignment with the internal muntin bars, and a plurality of intersecting, interior muntin bars having substantially the same width as the exterior muntin bars and affixed by adhesive means on the outer surface of the interior glass pane in coincidental alignment with the exterior muntin bars. All the muntin bars are arranged in a pattern to provide the window panel assembly with the appearance of a historically correct, authentic divided lite window having multiple individual panes separated by conventional muntin bars.

The internal muntin bars preferably are metallic and have a thickness slightly less than the width of the space between the glass panes. The exterior and interior muntin bars preferably are wooden and a thermally insulating spacer means is disposed between the internal muntin bars on the inner surfaces of the glass panes at selected locations to prevent contact between the internal muntin bars and the glass panes. In one embodiment, the internal muntin bars are made up of separate legs which are connected together at each intersection with a cross connector including a central portion which has a thickness approximating the width of the space between the glass panes and serves as the spacer.

The invention also provides a window assembly including a single pane of transparent sheet material, such as glass, a wooden window sash including a central opening smaller than the perimeter of the glass pane and a recess surrounding the opening and including a bottom wall in which a peripheral portion of the glass pane rests, a wooden, perimeter muntin frame covering the exterior surface of the peripheral portion of the glass pane and secured to the sash, a plurality of intersecting, wooden, exterior muntin bars connected to the perimeter frame and affixed by adhesive means on the exterior surface of the glass pane, and a plurality of intersecting, wooden, interior muntin bars affixed by adhesive means on the interior surface of the glass pane in coincidental alignment with the exterior muntin bars. The interior and exterior muntin bars have substantially the same width and are arranged in a pattern to provide the window assembly with the appearance of a historically correct, authentic divided lite window having multiple individual panes separated by conventional muntin bars.

DESCRIPTION OF THE PREFERRED EMBODIMENTS

Window panel assemblies embodying the invention can be used in room windows, doors and similar applications. The invention will be described in connection with exterior room windows.

Figure 1:
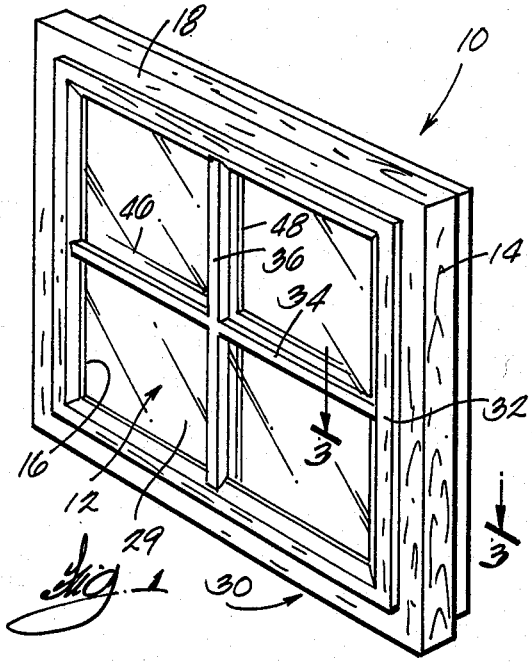
FIG. 1 is a front elevational view of a single pane window embodying the invention.
Figure 3:
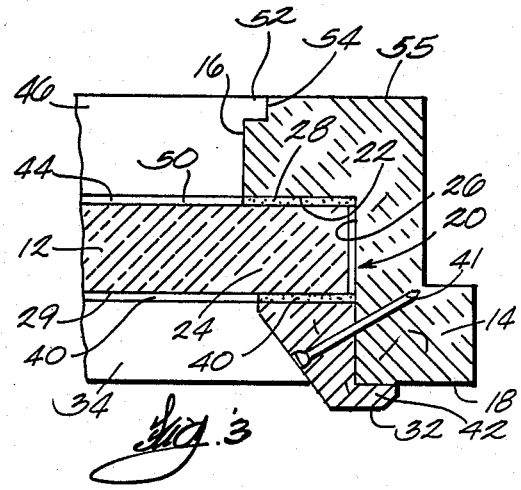
FIG. 3 is an enlarged, fragmentary, sectional view taken generally along line 3—3 in FIG. 1.
Figure 2:
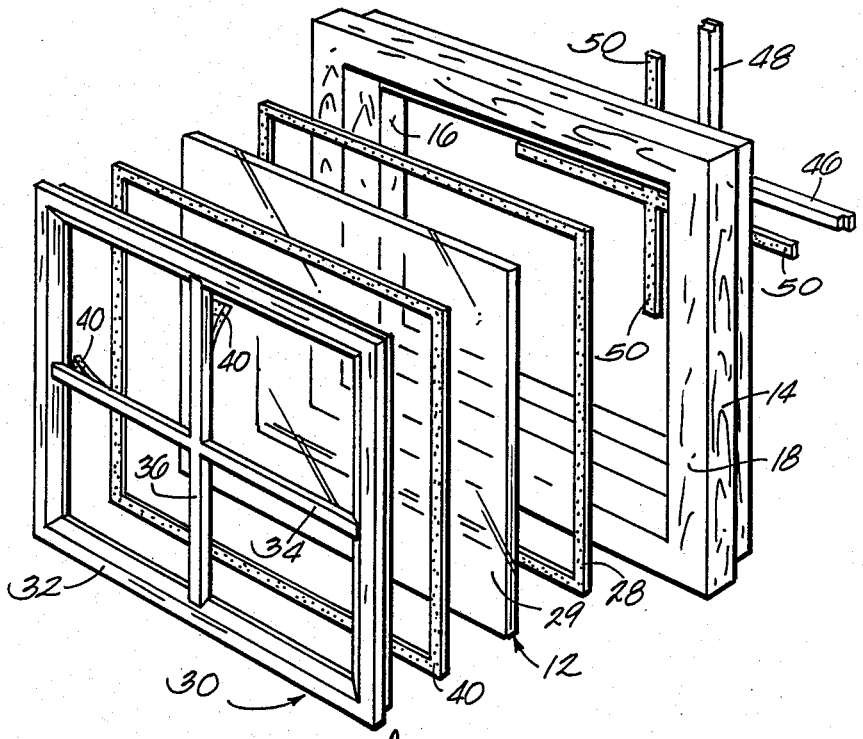
FIG. 2 is a perspective, exploded view of the window illustrated in FIG. 1.

FIG. 1–3 illustrate a window 10 including a single pane 12 of a transparent material, such as glass, a wooden frame or sash 14 having a central opening 16 which is smaller than the perimeter of the glass pane 12 and defines a glass sight line. The exterior face 18 of the sash 14 has a recess 20 surrounding the opening 16 and including a bottom wall 22 for receiving a peripheral portion 24 of glass pane 12 and a side wall 26. The peripheral portion 24 of the glass pane 12 is seated on a bedding 28 of conventional silicone or butyl caulking material applied on the bottom wall 22 of the sash recess 20.

Overlying the exterior surface 29 of the glass pane 12 is an exterior muntin grille 30 including a wooden perimeter frame 32 and a plurality (e.g., 2) of intersecting, wooden muntin bars 34 and 36. The outer surfaces of the exterior muntin bars 34 and 36 preferably are shaped to resemble conventional muntin bars interposed individual lites in authentic divided lite and French-style windows. The inner surfaces of the exterior muntin bars 34 and 36 and the perimeter frame 32 are flat. The exterior muntin bars 34 and 36 are affixed to the exterior surface 29 of the glass pane 12 by a suitable adhesive means. In a preferred embodiment, a double-sided, adhesive foam tape 40 (i.e , adhesive on both sides) is applied to the inner surfaces of the exterior muntin bars 34 and 36 and the perimeter frame 32.

When the exterior muntin grille 30 is moved into place and pressed against the exterior surface 29 of the glass pane 12 with the outer adhesive surface of the foam tape 40 exposed, the inner surfaces of the exterior muntin bars 34 and 36 become adhesively bonded onto the exterior surface 29 of the glass pane 12. The inner surfaces of the perimeter frame 32 also are adhesively bonded to the peripheral portion 24 of the glass pane 12. However, the primary purpose for applying the foam tape 40 on the inner surface of the perimeter frame 32 is to ensure that both the perimeter frame 32 and the exterior muntin bars 34 and 36 are spaced outwardly from the glass pane 12 at the same distance.

The perimeter frame 32 preferably is secured to the sash 14, such as with brads 41, staples or the like driven through the recess side wall 26. The perimeter frame 32 preferably has a portion 42 which overhangs the exterior face 18 of the sash 14. This overhang portion 42 hides gaps between the outer edge of the glass pane 12 and the sash 14 which can occur because of manufacturing tolerances.

Overlying the interior surface 44 of the glass pane 12 is a plurality (e.g., 2) intersecting wooden muntin bars 46 and 48 which have substantially the same width and are in registration or coincidental alignment with the exterior muntin bars 34 and 36, respectively. Like the exterior muntin bars 34 and 36, the interior muntin bars 46 and 48 have outer surfaces shaped to resemble conventional muntin bars, have flat inner surfaces and are adhesively affixed to the interior surface 44 of the glass pane 12, preferably with a double-sided, adhesive foam tape 50 like that described above. While the ends of the interior muntin bars 46 and 48 can be fastened to the sash 14 with brads, staples or the like, they preferably have an overhang portion 52 which fits into a recess 54 in the interior face 55 of the sash 14 and are held in place solely by the foam tape 50.

In the construction illustrated, the exterior and interior muntin bars 34, 36, 46 and 48 intersect at right angles and provide the window 10 with the appearance of an authentic divided lite window having four rectangular individual panes. The muntin bars can be arranged to provide the appearance of a larger number of individual panes and to form diamond-shaped, square, triangular, round or other patterns.

A single pane window constructed in accordance with the invention has a number of advantages over an authentic divided lite or French-style windows having a plurality of individual panes. For example, even though having an appearance which closely resembles a historically correct, authentic divided lite or French-style windows, it is less expensive to manufacture and assemble. Also, tests have shown or that it has load deflection characteristics superior to authentic divided lite or French-style windows having the same number and size of individual panes.

Figure 4:
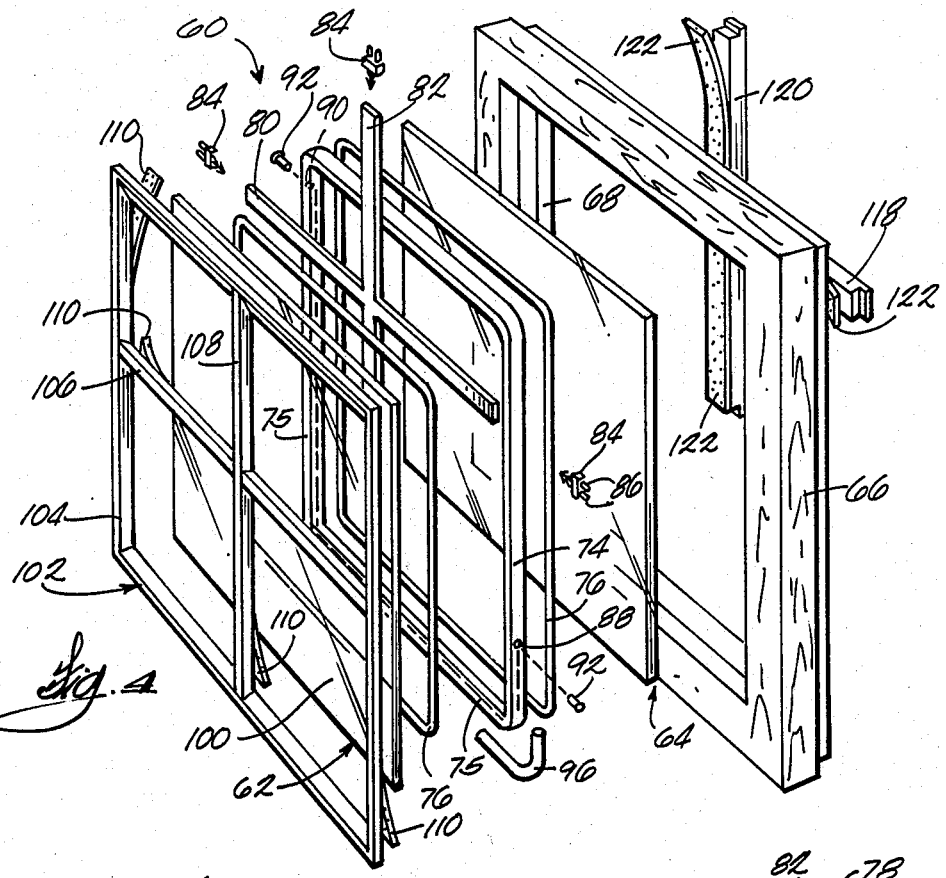
FIG. 4 is a perspective, exploded view of a dual-pane, insulated window embodying the invention.
Figure 5:
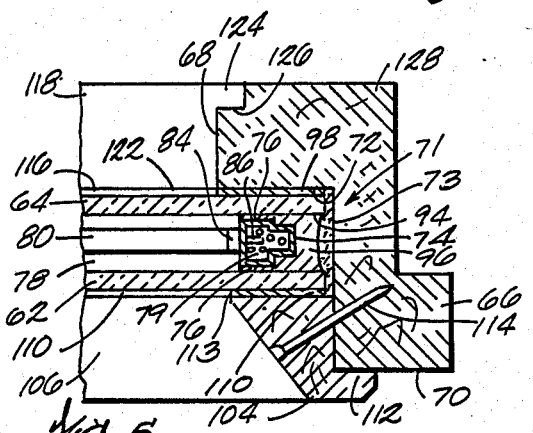
FIG. 5 is an enlarged, fragmentary, sectional view, similar to FIG. 3, of the dual-pane insulated window illustrated in FIG. 4.
Figure 6:
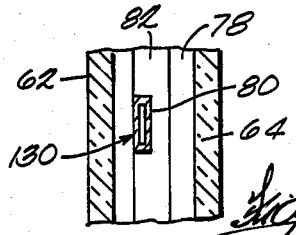
FIG. 6 is an enlarged, fragmentary, cross sectional view of the internal muntin bars for the window illustrated in FIG. 5, taken at the intersection of the internal muntin bars and shown with the exterior and interior muntin bars removed.

Illustrated in FIGS. 4–6 is a dual-pane, insulated window 60 including exterior and interior panes 62 and 64 of a transparent material, such as clear, transparent or low emissivity type glass, and a wooden frame or sash 66, similar to the sash 14 described above. The sash 66 has a central opening 68 which is smaller than the perimeter of the glass panes 62 and 64 and defines a glass sight line. The exterior face 70 of the sash 66 has a recess 71 surrounding the opening 68 and including a bottom wall 72 and a side wall 73.

Interposed the glass panes 62 and 64 for retaining them in parallel spaced relationship is a spacer frame 74 which is spaced inwardly a small distance from the outer edges of the glass panes 62 and 64. The spacer frame 74 preferably is constructed from hollow members, such as extruded aluminum. The glass panes 62 and 64 are hermetically sealed to the opposite edges of the spacer frame 74 by a suitable sealant 76, such as polyisobutylene (PIB), which also serves as a seal against migration of inert gas out of the space 78 between the glass panes 62 and 64. The hollow members of the spacer frame 74 preferably have a perforated inner face 75 and are at least partially packed with a suitable desiccant 79, such as a 3 Angstrom molecular sieve material, for absorbing residual moisture in the space 78 between the glass panes 62 and 64 and thereby minimizing a fogging condition caused by condensation of such moisture.

Disposed in the space 78 between the glass panes 62 and 64 is a plurality (e.g., 2) of intersecting, internal muntin bars 80 and 82 which are arranged in the desired pattern for simulating individual lites. The internal muntin bars 80 and 82 have a thickness slightly less than the width of the space 78 between the glass panes 62 and 64 and can be made from various suitable materials. In the specific construction illustrated, the horizontal muntin bar 80 intersects the vertical muntin bar 82 at a right angle and both internal muntin bars are hollow, have a rectangular cross section and are made from a metal, for example, extruded aluminum. If desired, they can be perforated and packed with a desiccant like the spacer frame 74. The outer ends of the internal muntin bars 80 and 82 are secured to the spacer frame 74 by suitable fastening means, such as plastic connectors 84 which fit into the hollow end of a muntin bar and have a pair of outwardly extending pins 86 which are received by mating holes (shown) in the spacer frame 74.

While the space 78 between the glass panes 62 and 64 can be filled with air, the insulating characteristics of the window assembly 60 can be improved by filling the space with a dry, inert gas, such as argon, krypton, or the like. The sound deadening characteristics can be improved by filling the space 78 mixture of gases is used, it is introduced through one or more small openings 88 in the spacer frame 74 after the internal muntin bars 80 and 82 have been installed and the glass panes 62 and 64 sealed to the spacer frame 74. Since the thickness of the internal muntin bars 80 and 82 is less than the width of the space 78 between the glass panes 62 and 64, there is sufficient room therebetween for the fill gas to flow freely through and fill the space 78. The spacer frame 74 includes one or more additional openings 90 through which air is expelled from the space 78 as it is being filled with the fill gas. The openings 88 and 90 in the spacer frame 74 are suitably plugged, such as with a river 92 or a molten plastic material, after the gas fill.

The marginal space 94 between the outer edges of the glass panes 62 and 64 and the outside of the space frame 74 is at least partially filled with a suitable sealant 96, such as a polyurethane, which serves as a seal against migration of moisture vapors into the space 78 between the glass panes 62 and 64.

The resulting glass panel assembly fits into the sash recess 72 with the exterior glass pane 62 facing downwardly as viewed in FIG. 5. A bedding 98 of a silicone or butyl caulking material for sealing the interior side of the glass panel assembly with the sash 66 preferably is applied to the recess bottom wall 72 prior to installing the glass panel assembly. Thin strips 99 of a plastic material mounted at spaced locations along the recess side wall 73 act as spacers for minimizing vertical and horizontal movement of the glass panel assembly relative to the sash 66 after installation.

Overlying the outer surface 100 of the exterior glass pane 62 is an exterior muntin grille 102 which is constructed and installed in substantially the same manner as described above. The exterior muntin grille 102 includes a wooden perimeter frame 104, a pair of intersecting wooden, interior muntin bars 106 and 108. The exterior muntin bars 106 and 108 are slightly wider than and in coincidental alignment with the internal muntin bars 80 and 82, respectively. The outer surfaces of the exterior muntin bars 106 and 108 are shaped to resemble conventional muntin bars. The inner surfaces of the perimeter frame 104 and the exterior muntin bars 106 and 108 are flat and are adhesively affixed to the outer surface 100 of the exterior glass pane 62, preferably with a double-sided, adhesive foam tape 110 like that described above.

The perimeter frame 104 preferably has an upper overhanging portion 112 and is secured to the sash 66 with brads 114, staples or the like driven into the recess side wall 73. The inner edge 115 of perimeter frame 104 preferably extends inwardly a short distance past the inside of the spacer frame 74. This serves to "hide" the metallic spacer frame 74 with wood and thereby eliminate a straight line for heat to travel through the glass panel assembly.

Overlying the outer surface 116 of the interior glass pane 64 is a pair of intersecting, wooden, muntin bars 118 and 120 which have substantially the same width as and are in coincidental alignment with the exterior muntin bars 106 and 108, respectively. Like the exterior muntin bars 106 and 108, the interior muntin bars 118 and 120 have an outer surface shaped to resemble conventional muntin bars, have flat inner surfaces and are adhesively affixed to the outer surface 116 of the interior glass pane 64 with a double-sided adhesive foam tape 122. The ends of the interior muntin bars 118 and 120 have an overhang portion 124 which fits into a recess 126 in the interior face 128 of the sash 66.

FIG. 6 illustrates the intersection or cross joint 130 of the internal muntin bars 80 and 82. The thickness of each internal muntin bar is reduced approximately 50% at the cross joint 130 so that they can be assembled in overlapping relationship and the total thickness of the cross joint 130 is not greater than the thickness of one of the internal muntin bars.

Figure 7:
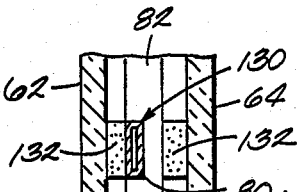
FIG. 7 is an enlarged, fragmentary, cross sectional view similar to FIG. 6 of an alternate arrangement for the internal muntin bars.

FIG. 7 illustrates an alternate embodiment wherein a small pad 132 of thermally insulative material, such as a plastic foam, is affixed on the opposite sides of the internal muntin bars, preferably at the cross joint 130. The pads 132 serve as spacers for preventing the glass panes 62 and 64 from contacting the internal muntin bars. Such contact can cause the formation of condensation of frost on the interior glass pane 64 as well as a thermal short circuit. The pads 132 also maintain an equal distance between the inner faces of the glass panes 62 and 64 and the interior muntin bars 80 and 82. The gas space between the glass panes and the internal muntin bars increases the overall thermal efficiency of the window assembly. When a gas fill is used this space also ensures free flow of fill gas throughout the space 78.

Figure 9:
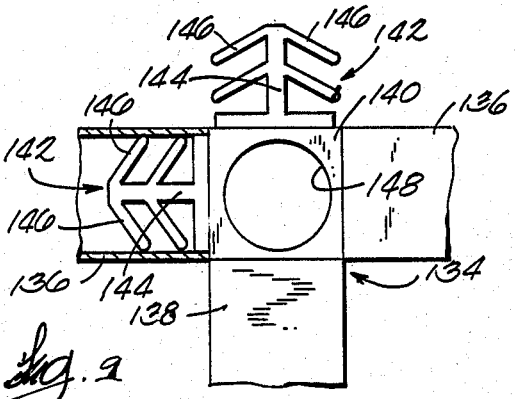
FIG. 9 is an enlarged, partially sectioned and partially broken away, elevational view of the cross connector for the internal muntin bar arrangement illustrated in FIG. 8.
Figure 8:
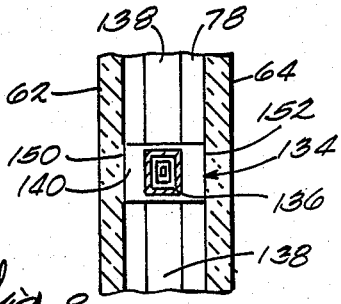
FIG. 8 is an enlarged, fragmentary, cross sectional view to FIG. 6 of another alternate arrangement for the internal muntin bars.

FIGS. 8 and 9 illustrate an alternate embodiment including a cross connector 134 for the internal muntin bars 80 and 82. In this embodiment, the horizontal and vertical muntin bars 80 and 82 are made up of a pair of separate legs 136 and 138 and the inner ends of these legs are connected together by the cross connector 134. The cross connector 134 is made from a thermally insulative material, preferably molded from a plastic material such as nylon, polyethylene, polypropylene, etc.

The cross connector 134 includes a central portion or hub 140 having a thickness approximating the width of the space 78 between the glass panes 62 and 64 and four fingers 142 (two shown) which extend radially outwardly from the hub 140 and fit snugly inside the inner ends of the legs 136, and 138. Each finger 142 has an elongated arm 144 extending radially outwardly from the hub 140 and a plurality of longitudinally spaced, winged members 146 extending from the opposite sides of the arm 144 in a barb-like or chevron-like pattern. The fingers 142 are dimensioned to fit snugly inside the internal muntin bar legs. The outermost lateral dimension of the wing members 146 is slightly larger than the inside width of the muntin bar arms. When a muntin bar arm is installed on a finger 142, the wing members 146 are compressed or deflected inwardly and thereby resist subsequent disengagement of the muntin bar arms. The hub 140 can include a central opening 148 as illustrated to reduce the amount of material required.

The opposite faces 150 and 152 of the cross connector hub 140 serve as spacers for maintaining an equal distance between the inner faces of the glass panes 62 and 64 and the internal muntin bar legs 136 and 138, much like the pads 132 in the embodiment illustrated in FIG. 7.

While the exterior and interior muntin bars preferably are wooden, they can be made from other suitable materials including metals and plastics. The internal muntin bars can be constructed from or variety of suitable materials other than metal including plastic and wood. Like in the embodiment illustrated in FIGS. 1–3, the exterior, interior, and internal muntin bars can be arranged to provide the appearance of a larger number of individual panes and to form a variety of different patterns.

A multiple pane, insulated window assembly constructed in accordance with the invention has a number of advantages. Although less expensive to manufacture than prior multiple pane constructions including individual panels, it has an appearance closely resembling a historically correct, authentic divided lite or French-style window because the interior and exterior muntin bars can have the same dimension and appearance of conventional sash bars. The internal muntin bars break up a convective flow of air or fill gas within the space between the glass panes which can cause the temperature gradient across the glass panes to vary considerable from top to bottom and condensation on the lower part of the interior glass pane. The internal and exterior muntin bars partially hide the interior muntin bars by virtue of being slightly wider and give the wood the appearance of a solid unit. Particularly when made of wood, the interior muntin bars act as a hear sink and distributes heat from a room into the interior glass pane, thereby lowering the temperature by which condensation occurs. In authentic divided lite window constructions, the wooden muntin bars extend from inside to outside and create a path for heat loss. The thermal efficiency of the window assembly can be improved by using a low emissivity glass, particularly for the interior pane.

From the foregoing description, one skilled in the art can easily ascertain the essential characteristics of the invention and, without departing from the spirit and scope thereof, make various changes and modifications to adapt it to various usages.

I claim:

1. An insulated window assembly comprising first and second generally parallel spaced panes of a transparent sheet material;

a plurality of intersecting, internal muntin bars disposed in the space between said first and second panes;

a plurality of first intersecting outer muntin bars having a width slightly wider than said internal muntin bars and affixed by adhesive means on the outer surface of said first pane in coincidental alignment with said internal muntin bars; and a plurality of second intersecting, outer muntin bars having substantially the same width as said first outer muntin bars and affixed by adhesive means on the outer surface of said second pane in coincidental alignment with said first outer muntin bars, said internal muntin bars and said first and second outer muntin bars being arranged in a pattern to provide said window assembly with the appearance of a historically correct, authentic divided lite window having individual panels separated by conventional muntin bars.

2. An insulated window assembly according to claim 1 wherein said internal muntin bars are metal and have a thickness which is slightly less than the width of the space between said panes; and said first and second outer muntin bars are wooden.

3. An insulated window assembly according to claim 2 wherein said window assembly includes thermally insulating spacer means disposed between said internal muntin bars and the inner surfaces of said first and second panes at selected locations to prevent said panes from touching said internal muntin bars.

4. An insulated window assembly according to claim 3 wherein said internal muntin bars include joint means at each intersection and having opposed sides; and said spacer means comprises a thermal insulating part disposed between each side of said joint means and the inner surface of said first and second panels, respectively.

5. An insulated window assembly according to claim 3 wherein said internal muntin bars, at each intersection, includes a plurality of legs extending radially outwardly from said intersection; and said spacer means comprises cross connector means at each intersection for interconnecting said legs and having a thickness approximating the space between said first and second panes.

6. An insulated window assembly according to claim 5 wherein said legs are tubular; and said connector means includes a plurality of fingers, each of which fits snugly inside one of said legs.

7. An insulated window assembly according to claim 6 wherein said connector means includes a hub; and each finger has an elongated arm extending radially outwardly from said hub and a plurality of longitudinally spaced wing members which extend from opposite sides of said arm in a chevron-like pattern and fit inside a said leg.

8. An insulated window assembly according to claim 2 including said first and second panes sealingly mounted on a spacer frame to form a subassembly having a peripheral portion;

a wooden window sash having a face, a central opening smaller than the perimeter of said subassembly and a recessed portion in said face adjacent said opening including a bottom wall on which the peripheral portion of said subassembly rests and a side wall; and a wooden, perimeter muntin frame covering said peripheral portion of said subassembly and secured to the side wall of said sash recessed portion, said first and second outer muntin bars having ends abutting said perimeter muntin frame.

9. An insulated window assembly acccording to claim 8 wherein said perimeter muntin frame includes a portion which over hangs said face of said sash and extends around the perimeter of said recessed portion.

10. An insulated window assembly according to claim 8 wherein said first and second panes are rectangular; and said first and second and internal muntin bars are patterned to define a plurality of rectangular-appearing individual panels.

11. An insulated window assembly according to claim 1 wherein said adhesive means is a double-side adhesive foam.

12. An insulated window assembly according to claim 1 wherein the space between said panes is filled with an inert gas.

13. An insulated window assembly according to claim 1 wherein one of said panes is a low emissivity glass.

* * * * *

US004783938B1

REEXAMINATION CERTIFICATE (2021st)

United States Patent [19] [11] B1 4,783,938

Palmer [45] Certificate Issued May 25, 1993

[54] WINDOW PANEL ASSEMBLY

[75] Inventor: Douglas J. Palmer, Mosinee, Wis.

[73] Assignee: SNE Enterprises, Inc., Wausau, Wis.

Reexamination Request:
No. 90/001,952, Mar. 9, 1990

Reexamination Certificate for:

| | |
|---|---|
| Patent No.: | **4,783,938** |
| Issued: | **Nov. 15, 1988** |
| Appl. No.: | **152,653** |
| Filed: | **Feb. 5, 1988** |

[51] Int. Cl.[5] ..... E06B 3/70
[52] U.S. Cl. ..... 52/171; 52/456; 52/790
[58] Field of Search ..... 52/171, 172, 456, 790, 52/304

[56] References Cited

U.S. PATENT DOCUMENTS

| | | | |
|---|---|---|---|
| 1,092,727 | 4/1914 | Linder . | |
| 2,877,516 | 3/1959 | Bobel | 52/172 |
| 3,308,593 | 3/1967 | Smith . | |
| 3,946,531 | 3/1976 | Armstrong | 52/456 |
| 4,222,213 | 9/1980 | Kessler | 52/790 |
| 4,598,520 | 7/1986 | Ellstrom | 52/456 |
| 4,652,472 | 3/1987 | Davies | 52/790 |
| 4,756,131 | 7/1988 | Stoakes | 52/171 |
| 4,850,175 | 7/1989 | Berdan | 52/172 |

FOREIGN PATENT DOCUMENTS

| | | |
|---|---|---|
| 2637034 | 2/1978 | Fed. Rep. of Germany . |
| 7924256 | 1/1979 | Fed. Rep. of Germany . |
| 8112473 | 8/1981 | Fed. Rep. of Germany . |
| 3403133 | 8/1988 | Fed. Rep. of Germany . |
| 2185516 | 7/1987 | United Kingdom . |

OTHER PUBLICATIONS

Produkt Information, one-page flyer in German and apparent English translation.
Polaroid photography of a window.

*Primary Examiner*—David A. Scherbel

[57] ABSTRACT

The insulated window assembly includes a pair of parallel-spaced glass panes, a plurality of intersecting metallic, internal muntin bars disposed, in the space between the glass panes, a plurality of intersecting, wooden, exterior muntin bars affixed on the outer surface of the exterior glass pane and a plurality of wooden intersecting interior muntin bars affixed on the outer surface of the interior glass pane. The internal muntin bars have a thickness less than the space between the glass panes. The exterior and interior muntin bars are slightly wider than the internal muntin bars and are coincidentally aligned with each other and with the internal muntin bars to give the window panel assembly the appearance of a historically correct, authentic divided life window having individual panes separated by conventional muntin bars.

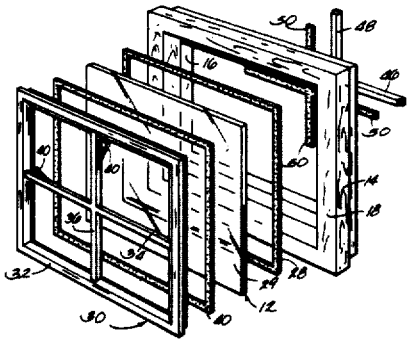

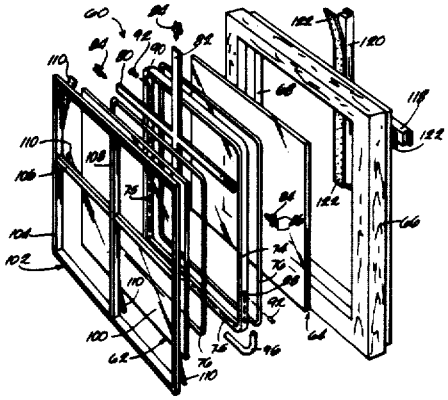

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are cancelled.

Claims 3, 8, 9 and 11–13 are determined to be patentable as amended.

Claims 4–7 and 10, dependent on an amended claim, are determined to be patentable.

New claims 14–18 are added and determined to be patentable.

3. An insulated window assembly [according to claim 2 wherein] *comprising:*

*first and second generally parallel spaced panes of a transparent sheet material;*

*a plurality of intersecting, internal muntin bars disposed in the space between said first and second panes;*

*a plurality of first intersecting outer muntin bars having a width slightly wider than said internal muntin bars and affixed by adhesive means on the outer surface of said first pane in coincidental alignment with said internal muntin bars;*

*a plurality of second intersecting, outer muntin bars having substantially the same width as said first outer muntin bars and affixed by adhesive means on the outer surface of said second pane in coincidental alignment with said first outer muntin bars, said internal muntin bars and said first and second outer muntin bars being arranged in a pattern to provide said window assembly with the appearance of a historically correct, authentic divided lite window having individual panels separated by conventional muntin bars;*

*wherein:*

*said internal muntin bars are metal and have a thickness which is slightly less than the width of the space between said panes;*

*said first and second outer muntin bars are wooden; and wherein:* said window assembly includes thermally insulating spacer means disposed between said internal muntin bars and the inner surfaces of said first and second panes at selected locations to prevent said panes from touching said internal muntin bars.

8. An insulated window assembly [according to claim 2 including] *comprising:*

*first and second generally parallel spaced panes of a transparent sheet material;*

*a plurality of intersecting, internal muntin bars disposed in the space between said first and second panes;*

*a plurality of first intersecting outer muntin bars having a width slightly wider than said internal muntin bars and affixed by adhesive means on the outer surface of said first pane in coincidental alignment with said internal muntin bars;*

*a plurality of second intersecting, outer muntin bars having substantially the same width as said first outer muntin bars and affixed by adhesive means on the outer surface of said second pane in coincidental alignment with said first outer muntin bars, said internal muntin bars and said first and second outer muntin bars being arranged in a pattern to provide said window assembly with the appearance of a historically correct, authentic divided lite window having individual panels separated by conventional muntin bars;*

*wherein:*

*said internal muntin bars are metal and have a thickness which is slightly less than the width of the space between said panes;*

*said first and second outer muntin bars are wooden; and wherein:* said first and second panes are sealingly mounted on a spacer frame to form a subassembly having a peripheral portion; and

*there is further provided:* a wooden window sash having a face, a central opening smaller than the perimeter of said subassembly and a recessed portion in said [pane] *face* adjacent said opening including a bottom wall on which the peripheral portion of said subassembly rests and a side wall; and

[a wooden, perimeter muntin frame covering said peripheral portion of said subassembly and secured to the side wall of said sash recessed portion, said first and second outer muntin bars having ends abutting said perimeter muntin frame.]

*a separate wooden perimeter muntin frame subassembly which includes a perimeter frame and outer muntin bars secured to and having ends abutting said perimeter frame, said frame subassembly constructed to cover the peripheral portion of said pane subassembly and for securement to said side wall of said sash recessed portion.*

9. An insulated window assembly according to claim 8 wherein said perimeter muntin frame *subassembly* includes a portion which over hangs said face of said sash and extends around the perimeter of said recessed portion.

11. An insulated window assembly according to claim [1] *3* wherein said adhesive means in a double-side adhesive foam.

12. An insulated window assembly according to claim [1] *3* wherein the space between said panes is filled with an inert gas.

13. An insulated window assembly according to claim [1] *3* wherein one of said panes is a low emissivity glass.

*14. An insulated window assembly according to claim 8, wherein said adhesive means is a double-side adhesive foam.*

*15. An insulated window assembly according to claim 8, wherein the space between said panes is filled with an inert gas.*

*16. An insulated window assembly according to claim 8, wherein one of said panes is a low emissivity glass.*

*17. An insulated window assembly comprising:*

*first and second generally parallel spaced panes of a transparent sheet material;*

*a plurality of intersecting, internal muntin bars disposed in the space between said first and second panes, wherein each of said bars is constructed of metal and having a thickness which is slightly less than the width of the space between said panes for spacing the members from the panes, and wherein each of said internal muntin bars are defined by a one-piece elongated member which defines a notch-like structure which is constructed to form an intersecting, overlapping and interconnecting internal muntin joint;*

*a plurality of first intersecting outer muntin bars having a width slightly wider than said internal muntin bars and affixed by adhesive means on the outer surface of said first pane in coincidental alighment with said internal muntin bars;*

*a plurality of second intersecting outer muntin bars having substantially the same width as said first outer muntin bars and affixed by adhesive means on the outer surface of said second pane in coincidental alignment with said first outer muntin bars, said internal muntin bars and said first and second outer muntin bars being arranged in a pattern to provide said window assembly with the appearance of a historically correct, authentic divided lite window having individual panels separated by conventional muntin bars; and*

*with respect to the intersecting internal muntin bars, the intersecting first outer muntin bars and the intersecting second outer muntin bars;*

*the number of internal muntin intersections is the same as the number of first outer muntin intersections and the same as the number of second outer muntin intersections;*

*each internal muntin intersection corresponds with a first outer muntin intersection and a second outer muntin intersection;*

*only one internal muntin intersection corresponds with a first outer muntin intersection and a second outer muntin intersection;*

*each internal muntin intersection is positioned between a first outer muntin intersection and a second outer muntin intersection;*

*said first and second panes sealingly mounted on a spacer frame to form a subassembly having a peripheral portion;*

*a wooden window sash having a face, a central opening smaller than the perimeter of said subassembly and a recessed portion in said face adjacent said opening including a bottom wall on which the peripheral portion of said subassembly rests in a side wall;*

*a separate wooden perimeter muntin frame subassembly which includes a perimeter frame and outer muntin bars secured to and having ends abutting said perimeter frame, said frame subassembly constructed to cover the peripheral portion of said pane subassembly and for securement to said side wall of said sash recessed portion; and*

*said perimeter muntin frame subassembly includes a portion which over hangs said face of said sash and extends around the perimeter of said recessed portion.*

*18. An insulated window assembly comprising:*

*first and second generally parallel spaced panes of a transparent sheet material;*

*a plurality of intersecting, internal muntin bars disposed in the space between said first and second panes, wherein each of said bars is constructed of metal and having a thickness which is slightly less than the width of the space between said panes for spacing the members from the panes, wherein said internal muntin bars includes a plurality of one-piece elongated arm-like tubular members, a separate connector member for connection to an end of each tubular member so as to form an intersecting joint and interconnect said tubular members;*

*a plurality of first intersecting outer muntin bars having a width slightly wider than said internal muntin bars and affixed by adhesive means on the outer surface of said first pane in coincidental alignment with said internal muntin bars;*

*a plurality of second intersecting outer muntin bars having substantially the same width as said first outer muntin bars and affixed by adhesive means on the outer surface of said second pane in coincidental alignment with said first outer muntin bars, said internal muntin bars and said first and second outer muntin bars being arranged in a pattern to provide said window assembly with the appearance of a historically correct, authentic divide lite window having individual panels separated by conventional muntin bars; and*

*with respect to the intersecting internal muntin bars, the intersecting first outer muntin bars and the intersecting second outer muntin bars:*

*the number of internal muntin intersections is the same as the number of first outer muntin intersections and the same as the number of second outer muntin intersections;*

*each internal muntin intersection corresponds with a first outer muntin intersection and a second outer muntin intersection;*

*only one internal muntin intersection corresponds with a first outer muntin intersection and a second outer muntin intersection:*

*each internal muntin intersection is positioned between a first outer muntin intersection and a second outer muntin intersection;*

*said first and second panes sealingly mounted on a spacer frame to form a subassembly having a peripheral portion;*

*a wooden window sash having a face, a central opening smaller than the perimeter of said subassembly and a recessed portion in said face adjacent said opening including a bottom wall on which the peripheral portion of said subassembly rests in a side wall;*

*a separate wooden perimeter muntin frame subassembly which includes a perimeter frame and outer muntin bars secured to and having ends abutting said perimeter frame, said frame subassembly constructed to cover the peripheral portion of said pane subassembly and for securement to said side wall of said sash recessed portion; and*

*said perimeter muntin frame subassembly includes a portion which over hangs said face of said sash and extends around the perimeter of said recessed portion.*

* * * * *